US010866066B2

(12) United States Patent
Ma et al.

(10) Patent No.: US 10,866,066 B2
(45) Date of Patent: Dec. 15, 2020

(54) GUN CLAMP EASY TO BE DISMOUNTED AND ADJUSTED IN POSITION AND A GUN MOUNTED LIGHT THEREON

(71) Applicant: Shenzhen Olight E-Commerce Technology Co., Ltd., Guangdong (CN)

(72) Inventors: Qiang Ma, Shanxi (CN); Ziyang Zhou, Hubei (CN)

( * ) Notice: Subject to any disclaimer, the term of this patent is extended or adjusted under 35 U.S.C. 154(b) by 0 days.

(21) Appl. No.: 16/544,932

(22) Filed: Aug. 20, 2019

(65) Prior Publication Data

US 2020/0011642 A1 Jan. 9, 2020

(30) Foreign Application Priority Data

Jul. 26, 2019 (CN) ..... 2019 1 0680854

(51) Int. Cl.
*F41G 11/00* (2006.01)
*F41G 1/35* (2006.01)
*F21V 21/088* (2006.01)

(52) U.S. Cl.
CPC ..... *F41G 11/003* (2013.01); *F21V 21/088* (2013.01); *F41G 1/35* (2013.01)

(58) Field of Classification Search
CPC ..... F41G 1/35; F41G 11/003; F41G 11/001; F41G 11/004; F41G 1/34; F21V 21/088; F21V 21/0885
USPC ..... 42/146, 148
See application file for complete search history.

(56) References Cited

U.S. PATENT DOCUMENTS 5,941,489 A * 8/1999 Fanelli ..... F41G 1/16 248/298.1
7,140,143 B1 * 11/2006 Ivey ..... F41G 11/003 42/125
9,488,446 B2 * 11/2016 Zimmer ..... F41G 11/003
10,247,520 B2 * 4/2019 Manly ..... F16B 21/186
2008/0168696 A1 * 7/2008 Orne ..... F41A 35/00 42/90
2008/0178511 A1 * 7/2008 Storch ..... F41C 27/00 42/90
2010/0229450 A1 * 9/2010 Becker ..... F41G 1/35 42/90
2011/0067287 A1 * 3/2011 Collin ..... F41G 11/003 42/119
2011/0247255 A1 * 10/2011 Ding ..... F41G 11/003 42/90
2016/0097614 A1 * 4/2016 Manly ..... F16B 21/186 42/90

* cited by examiner

*Primary Examiner* — Jonathan C Weber
(74) *Attorney, Agent, or Firm* — Prakash Nama; Global IP Services, PLLC

(57) ABSTRACT

A gun clamp having a base and a slider; one side of the base is provided with a clamping assembly; another side of the base is provided with a first sliding groove; a side wall of the base is provided with a second sliding groove; the slider is cooperative with and insertable into the first sliding groove and the second sliding groove; a main shaft is provided in the base; an end of the main shaft proximal to the first sliding groove is provided with a first locking piece; an end of the main shaft proximal to the second sliding groove is provided with a second locking piece; an end of the main shaft distal from the second locking piece is connected with a switch; a resilient piece is provided between the switch and the base. Also provided is a gun mounted light provided with the gun clamp.

18 Claims, 8 Drawing Sheets

GUN CLAMP EASY TO BE DISMOUNTED AND ADJUSTED IN POSITION AND A GUN MOUNTED LIGHT THEREON

BACKGROUND OF THE INVENTION

The present invention relates to the technical field of gun mounted light, and more specifically relates to a gun clamp easy to be dismounted and adjusted in position and a gun mounted light thereon.

During the use of a common rifle mounted light, when a scope is required to be mounted on the barrel, the user may be visually obstructed when using the scope due to the rifle mounted light which is fixedly mounted on the barrel. Also, an existing gun clamp can only fix the gun mounted light at one side of a rail. When it is required to adjust direction, additional tools have to be used to dismount the gun mounted light, and as such, it is not convenient to dismount the gun mounted light and such inconvenience will result in bad user's experience. When it is required to mount the gun mounted light at different sides of the rail, a currently available solution is to provide multiple gun clamps on the rail, however, this solution burdens the rail by additional weights and thus affects user's experience.

BRIEF SUMMARY OF THE INVENTION

In view of the aforesaid disadvantages now present in the prior art, the present invention provides a gun clamp easy to be dismounted and adjusted in position and a gun mounted light thereon, so as to facilitate dismounting of the gun mounted light and changing the mounting position of the gun mounted light.

The present invention provides the following technical solutions:

A gun clamp easy to be dismounted and adjusted in position, comprising a base and a slider; one side of the base is provided with a clamping assembly; another side of the base opposite to the side of the base provided with the clamping assembly is provided with a first sliding groove; a side wall of the base is provided with a second sliding groove; the slider is cooperative with and insertable into the first sliding groove and the second sliding groove; a main shaft is provided in the base connecting the first sliding groove and the second sliding groove; an end of the main shaft proximal to the first sliding groove is provided with a first locking piece; an end of the main shaft proximal to the second sliding groove is provided with a second locking piece.

Preferably, an end of the main shaft distal from the second locking piece is connected with a switch; the switch is positionally limited at another side wall of the base distal from the second sliding groove.

Preferably, a resilient piece is provided between the switch and the base.

Preferably, the first locking piece comprises a first blocking piece and a first recess; the first recess is positioned adjacent to an end of the first blocking piece proximal to the switch.

Preferably, the second locking piece comprises a second blocking piece and a second recess; the second blocking piece is positioned adjacent to an end of the second recess distal from the switch.

Preferably, one side of the slider comprises a third blocking piece, a fourth blocking piece and a position limiting groove; the position limiting groove is positioned between the third blocking piece and the fourth blocking piece.

Preferably, a position limiting panel is provided at a side of the base corresponding to openings of the first sliding groove and the second sliding groove opposite to opposite openings of the first sliding groove and the second sliding groove from which the slider is inserted.

Preferably, a side of the position limiting panel proximal to the base is provided with a first ball-headed rod; the first ball-headed rod is positioned corresponding to the first sliding groove.

Preferably, a side of the position limiting panel proximal to the base is provided with a second ball-headed rod; the second ball-headed rod is positioned corresponding to the second sliding groove.

A gun mounted light, comprising a light; one side of the light is provided with the gun clamp easy to be dismounted and adjusted in position according to the above description.

The present invention has the following beneficial advantages:

The base of the present invention is provided with two sliding grooves at two different positions for mounting the light, therefore only one gun clamp is required to be mounted to a rail of the gun in order to mount the light at different positions with respect to the rail. Also, two locking pieces are provided on one and the same main shaft, such that by operating one and the same switch, the two sliding grooves can be opened, thereby facilitating operation by the users. Further, ball-headed rods are provided on the position limiting panel of the present invention to provide buffering forces for the slider in order to prevent instability of the gun clamp and the base caused by impact of the slider.

REFERENCES IN THE FIGURES

Figure 1:
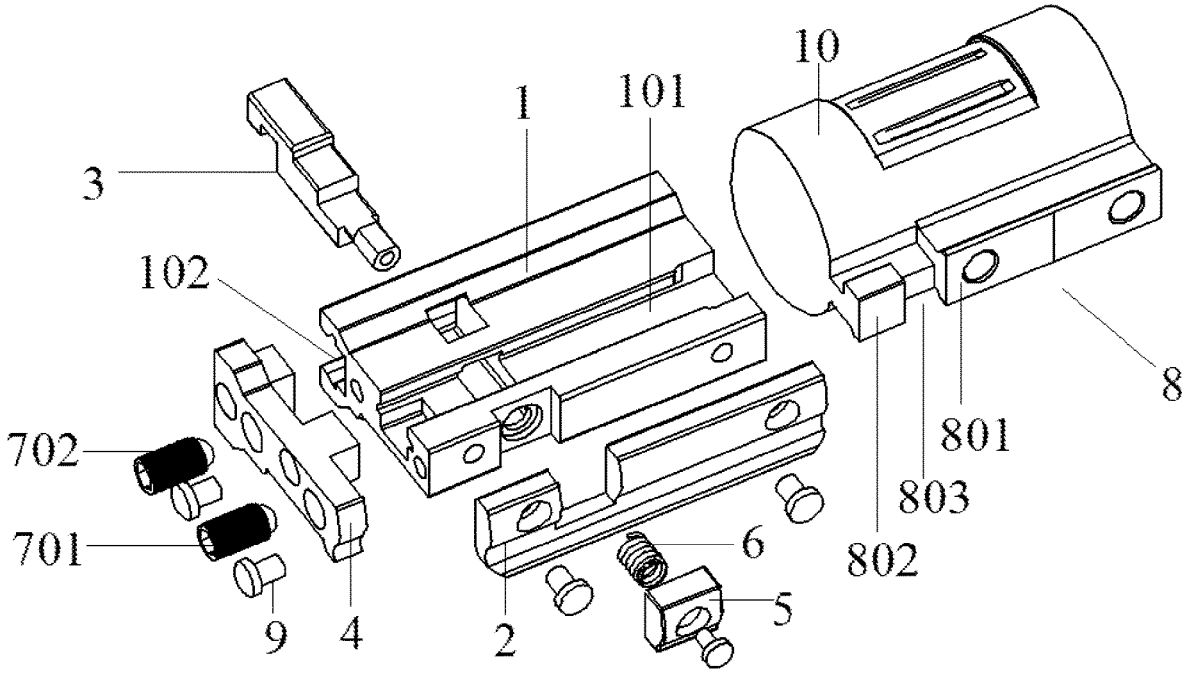
FIG. 1 is an exploded structural view of the gun mounted light of the present invention.

1—base; 101—first sliding groove; 102—second sliding groove; 103—first clamping portion; 104—mounting groove; 105—position limiting platform; 2—clamping block; 201—second clamping portion; 3—main shaft; 301—connecting shaft; 302—first recess; 303—first blocking piece; 304—second recess; 305—second blocking piece; 4—position limiting panel; 5—switch; 6—resilient piece; 701—first ball—headed rod; 702—second ball—headed rod; 8—slider; 801—third blocking piece; 802—fourth blocking piece; 803—position limiting groove; 9—pin; 10—light.

DETAILED DESCRIPTION OF THE INVENTION

Some embodiments of the present invention are further described in detail below. The embodiments are illustrated in the figures. Identical or like references throughout the description and the figures represent identical or like components or components having the same or similar functions. The embodiments described below with reference to the figures should be considered illustrative for the purpose of explaining the technical features of the present invention, and should not be considered as any limitation to the present invention.

In the present invention, it should be noted that directions or positional relationships indicated by terms such as "length", "width", "upper", "lower", "front", "rear", "left", "right", "vertical", "horizontal", "top", "bottom" should be understood based on the directions or positional relationships according to the figures, and should also be understood as merely means for simplification for the sake of easier illustration of the present invention. It is not meant or intended to mean that the devices or components concerned should have such specifically described directions, or should be configured or operated according to the specifically described directions, and hence should not be considered as any limitation to the present invention.

Further, terms like "first", "second" are used for illustrative purpose, and should not be understood as meaning or implying relative importance or as a subtle indication of a quantity of the described technical feature. Therefore, a feature defined by "first" or "second" may comprises by obvious indication or subtle implication, one or more than one of said feature in terms of quantity. In the description, "a plurality of" means a quantity of two or above, unless otherwise specified.

In the present invention, unless otherwise specified, terms such as "install", "connect", "communicate" and "fix" should be understood broadly. For example, a fixed connection, a removable connection, or integral formation may be intended. Further, connection may be mechanical or electrical, direct or indirect through a medium, and may be an internal communication between two components or an interactive relationship between two components. A person skilled in this field of art should be able to understand the specific meaning of the terms described in the present invention according to the context of the practical situation described.

As shown in FIG. 1 to FIG. 6, an embodiment of a gun clamp easy to be dismounted and adjusted in position is provided, comprising a base 1 and a slider 8; one side of the base 1 is provided with a clamping assembly; another side of the base 1 opposite to the side of the base provided with the clamping assembly is provided with a first sliding groove 101; a side wall of the base 1 is provided with a second sliding groove 102; the slider 8 cooperates with the first sliding groove 101 and the second sliding groove 102; a main shaft 3 is provided in the base 1 connecting the first sliding groove 101 and the second sliding groove 102; an end of the main shaft 3 proximal to the first sliding groove 101 is provided with a first locking piece; an end of the main shaft 3 proximal to the second sliding groove 102 is provided with a second locking piece.

Figure 4:
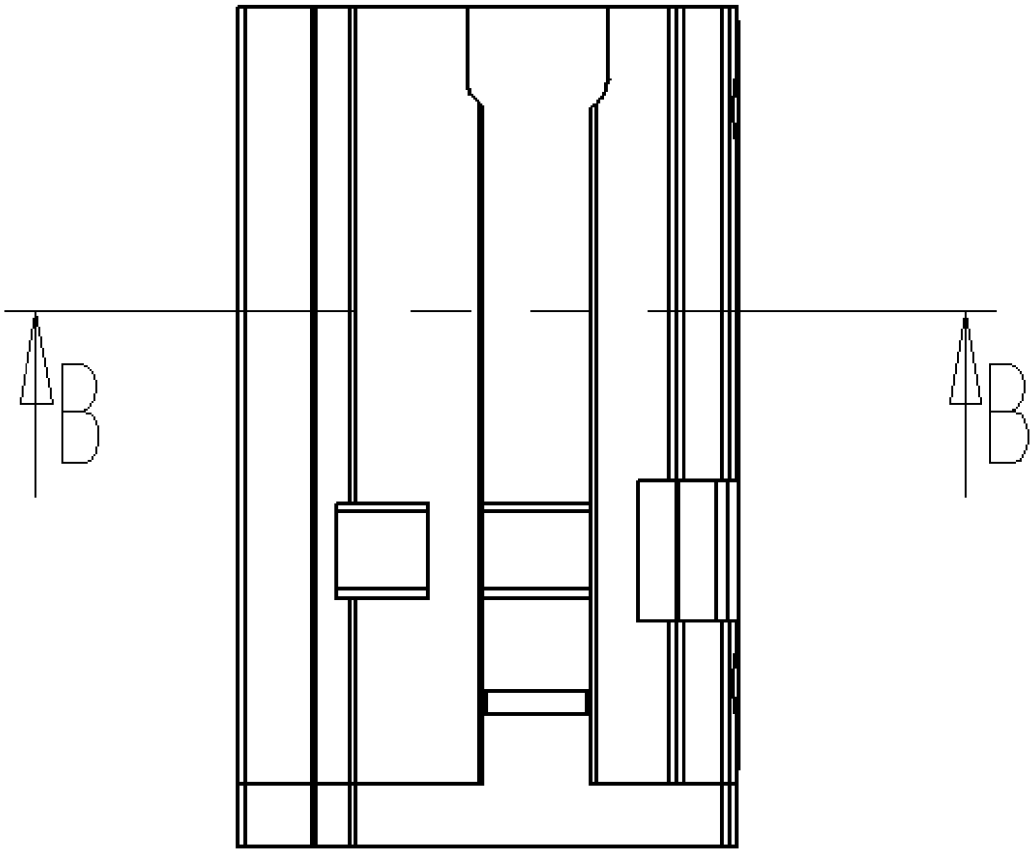
FIG. 4 is a top plan view of the base of the present invention.
Figure 5:
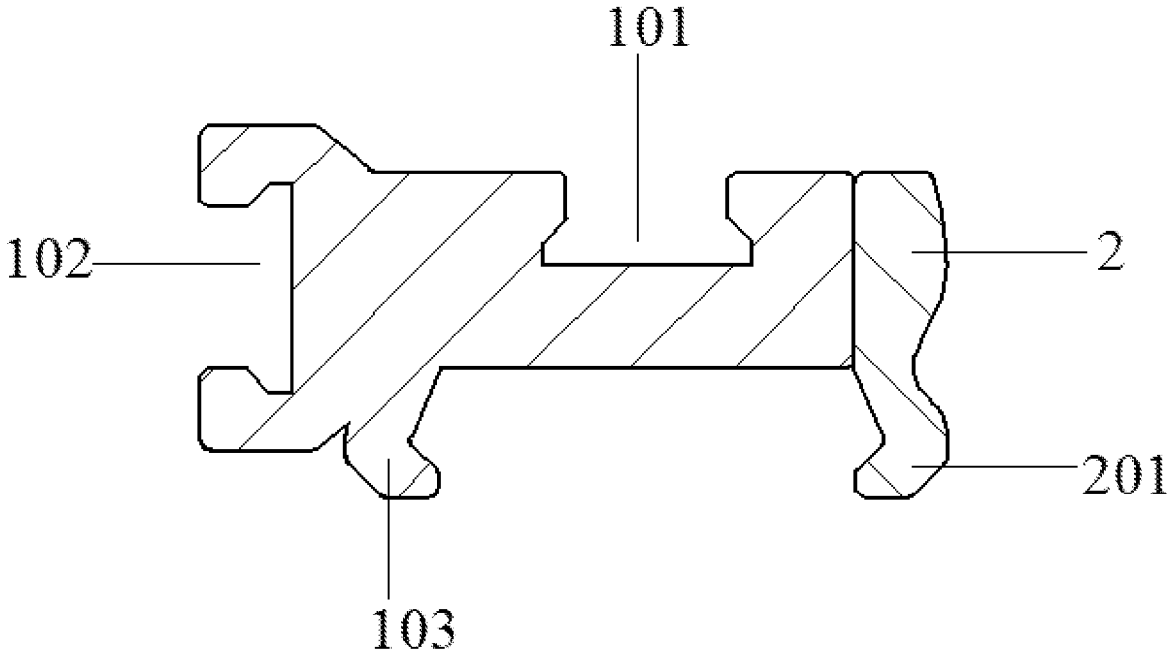
FIG. 5 is a schematic sectional view along line B-B shown in FIG. 4.

As shown in FIG. 4 and FIG. 5, the clamping assembly according to the present embodiment comprises a first clamping portion 103 and a second clamping portion 201. According to an embodiment, a portion of the base 1 extends downwardly from a bottom side thereof to form the first clamping portion 103; another side wall of the base 1 is fixedly connected with a clamping block 2; a portion of the clamping block 2 extends towards the same direction as the first clamping portion 103 to form the second clamping portion 201; the first clamping portion 103 and the second clamping portion 201 are positioned oppositely with respect to each other and face towards each other; a side of the first clamping portion 103 proximal to the second clamping portion 201 is provided with a recessed surface recessed towards a direction away from the second clamping portion 201; likewise, a side of the second clamping portion 201 proximal to the first clamping portion 103 is also provided with another recessed surface recessed towards a direction away from the first clamping portion 103, such that the clamping assembly engages with a surface of a rail to achieve stable clamping effect.

Figure 2:
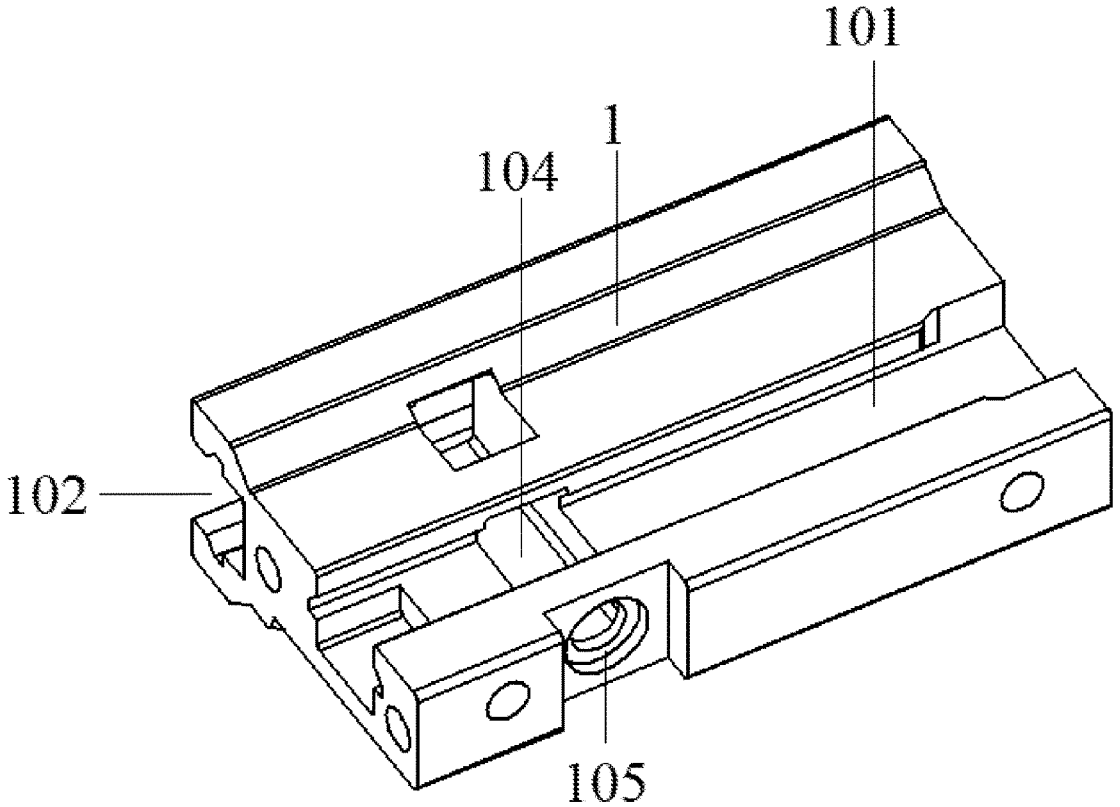
FIG. 2 is a schematic structural view of the base of the present invention.

As shown in FIG. 2 and FIG. 5, said another side of the base 1 opposite to the side of the base provided with the clamping assembly is provided with the first sliding groove 101; the first sliding groove 101 has a cross section having a shape resembling a trapezium; the slider 8 also has a shape resembling a trapezium corresponding to the cross section of the first sliding groove 101, so that when the slider 8 is placed within the first sliding groove 101, the slider 8 is being limited in position along a direction perpendicular to a bottom surface of the first sliding groove 101 in order to prevent the slider 8 from falling out of the first sliding groove 101 along the direction perpendicular to the bottom surface of the first sliding groove 101. According to an embodiment, a direction which the first sliding groove 101 extends along the base 1 is the same as a direction which the clamping assembly extends along the base 1.

In some other embodiments, the direction which the first sliding groove 101 extends along the base 1 and the direction which the clamping assembly extends along the base 1 are perpendicular to each other or otherwise different from each other such that a certain angle such as an acute angle is formed between the two directions.

According to an embodiment, the side wall of the base 1 is provided with the second sliding groove 102; the second sliding groove 102 has a cross section having a shape resembling a trapezium, such that when the slider 8 is placed within the second sliding groove 102, the slider 8 is being limited in position along a direction perpendicular to a bottom surface of the second sliding groove 102 in order to prevent the slider 8 from falling out of the second sliding groove 102 along the direction perpendicular to the bottom surface of the second sliding groove 102. According to an embodiment, a direction which the second sliding groove 102 extends along the base 1 is the same as the direction which the first sliding groove 101 extends along the base 1.

According to an embodiment, a mounting groove 104 is provided inside the base 1 to mount the main shaft 3; the first sliding groove 101 and the second communication groove 102 are in communication with each other through the mounting groove 104; the main shaft 3 is positioned in the mounting groove 104; one end the main shaft 3 penetrates through the second sliding groove 102 so as to communicate with external environment; another end of the main shaft 3 distal from the second sliding groove 102 is provided with a connecting shaft 301; the connecting shaft 301 penetrates through a side wall of a side of the first sliding groove 101 distal from the second sliding groove 102 so as to be connected with a switch 5. In some other embodiments, the connecting shaft 301 and the switch 5 are fixed connected via a pin 9.

In some other embodiments, the connecting shaft 301 may be fixedly connected with the switch 5 by other methods such as welding and threaded connection.

Figure 6:
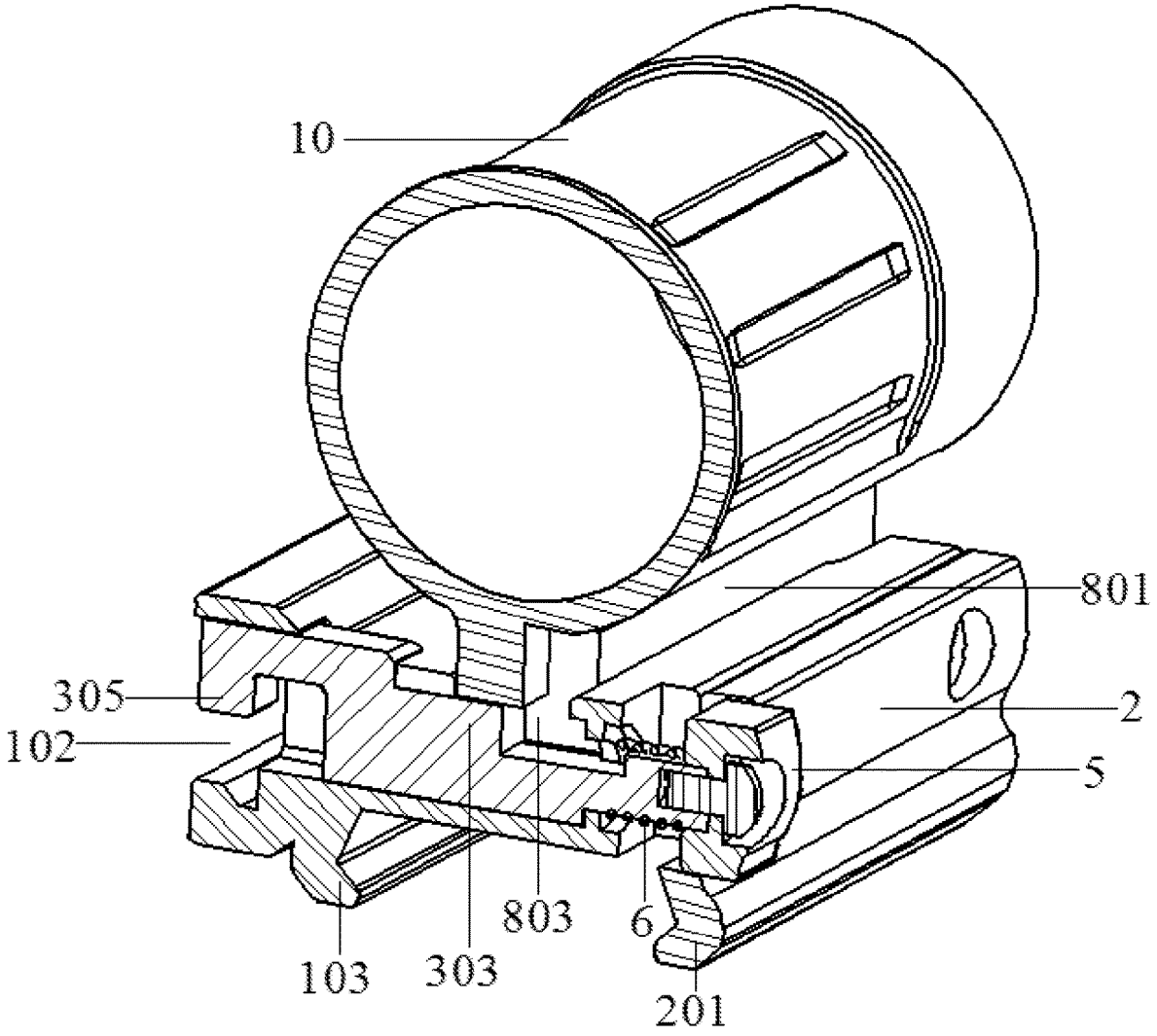
FIG. 6 is a schematic sectional view of the present invention when the gun clamp is in a locked condition.

As shown in FIG. 2 and FIG. 6, a resilient piece 6 is provided between the switch 5 and said another side wall of the base 1; one end of the resilient piece 6 abuts against the switch 5, another end of the resilient piece 6 abuts against said another side wall of the base 1, such that the switch 5 is biased towards a direction away from the base 1, thereby also pulling the main shaft 3 towards the same direction which the switch 5 is biased. In some embodiments, a side of said another side wall of the base 1 proximal to the switch 5 is provided with a position limiting platform 105 for the resilient piece 6 which is a position limiting spring, so as to prevent any problems that may have occurred to the resilient piece 6 such as tilting, thereby ensuring that the resilient piece 6 provides stable resilient force. As said, the resilient piece 6 may be a spring, and the spring sleeves the connecting shaft 301.

In some other embodiments, the resilient piece 6 may also be other resilient objects such as a resilient strip or a soft piece of article, and is placed around the connecting shaft 301 surrounding the connecting shaft 301.

Figure 3:
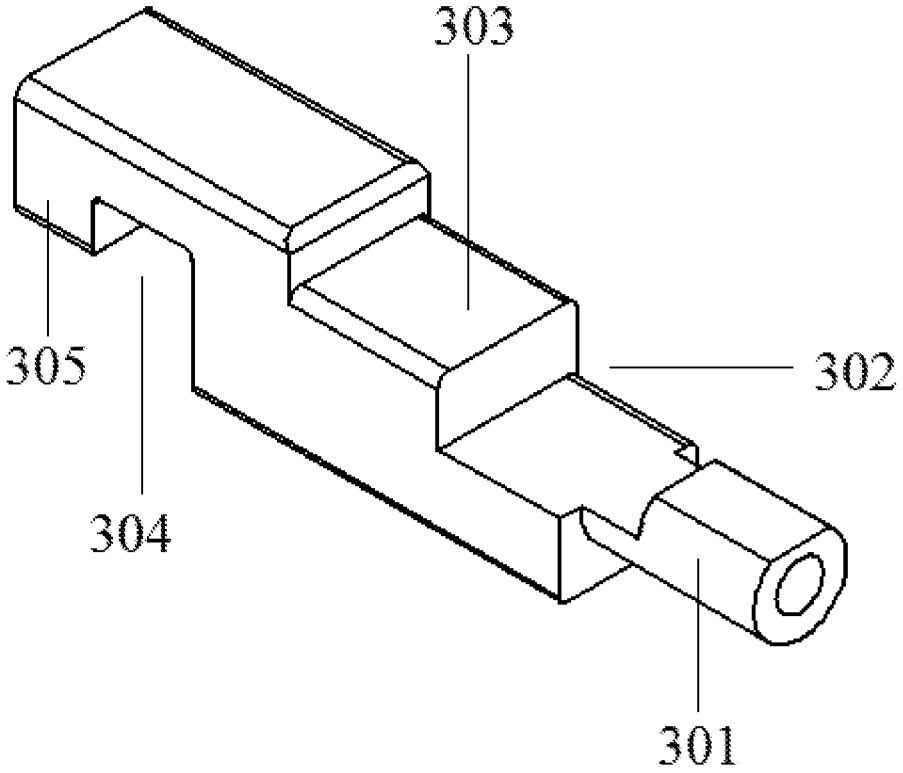
FIG. 3 is a schematic structural view of the main shaft of the present invention.

In an embodiment shown in FIG. 3, the first locking piece of the main shaft 3 is proximal to the connecting shaft 301; the second locking piece is provided at an end of the main shaft 3 distal from the connecting shaft 301.

According to an embodiment, the first locking piece is positioned corresponding to the first sliding groove 101; the first locking piece comprises a first blocking piece 303 and a first recess 302; the first recess 302 is positioned adjacent to an end of the first blocking piece 303 proximal to the connecting shaft 301; the first recess 302 and the first blocking piece 303 are positioned at a side of the main shaft 3 distal from the bottom surface of the mounting groove 104; the first blocking piece 303 is protruded with respect to the first recess 302 towards a direction away from the bottom surface of the mounting groove 104.

According to an embodiment, the second locking piece is positioned corresponding to the second sliding groove 102; the second locking piece comprises a second blocking piece 305 and a second recess 304; the second blocking piece 305 is positioned adjacent to an end of the second recess 304 distal from the connecting shaft 301. In the embodiment, the second blocking piece 305 and the second recess 304 are positioned at a side of the main shaft 3 distal from the first blocking piece 303; in other words, the second blocking piece 305 and the first blocking piece 303 extend in mutually opposite directions.

During use, press and hold the switch 5 to overcome the resilient force of the resilient piece 6, such that the main shaft 3 is driven away from the clamping block 2, as such, the first recess 302 will align with and thus will be in communication with the first sliding groove 101, and the second recess 304 will also align with and thus will be in communication with the second sliding groove 102, such that the slider 8 can slide over the main shaft 3 along the first sliding groove, or slide over the main shaft along the second sliding groove 102 if the slider 8 is placed in the second sliding groove 102; when the switch 5 is released, the main shaft 3 resets, such that the first blocking piece 303 corresponds to the first sliding groove 101 and the second blocking piece 305 corresponds to the second sliding groove 102, so as to block the sliding movement of the slider 8 along the first sliding groove 101 or the sliding movement of the slider 8 along the second sliding groove 102.

In the embodiment shown in FIG. 1, the slider 8 comprises a third blocking piece 801, a fourth blocking piece 802 and a position limiting groove 803; the position limiting groove 803 is positioned between the third blocking piece 801 and the fourth blocking piece 802; when the slider 8 is in the first sliding groove 101 or the second sliding groove 102, the first blocking piece 303 or the second blocking piece 305 provided on the main shaft 3 cooperates with the position limiting groove 803 provided on the slider 8 to fix the slider 8 within the first sliding groove 101 or the second sliding groove 102 respectively.

In an embodiment shown in FIG. 1, one end of the base 1 proximal to main shaft 3 is provided with a position limiting panel 4; the position limiting panel 4 corresponds to openings of the first sliding groove 101 and the second sliding groove 102 opposite to openings from which the slider is inserted, so as to achieve position limiting of the slider 8 along the direction which the first sliding groove 101 and the second sliding groove 102 extend, to prevent the slider 8 from falling out. According to an embodiment, a side of the position limiting panel 4 proximal to the base 1 is provided with a first ball-headed rod 701 and a second ball-headed rod 702; the first ball-headed rod 701 is positioned corresponding to the first sliding groove 101; the second ball-headed rod 702 is positioned corresponding to the second sliding groove 102; each of the first ball-headed rod 701 and the second ball-headed rod 702 is provided with a resilient member inside to act as a buffer upon impact by an object; therefore, when the slider 8 is mounted into the first sliding groove 101 or the second sliding groove 102, impact by the slider 8 will be buffered by the first ball-headed rod 701 or the second ball-headed rod 702 to prevent instability of the gun clamp and the base caused by impact of the slider 8.

Figure 7:
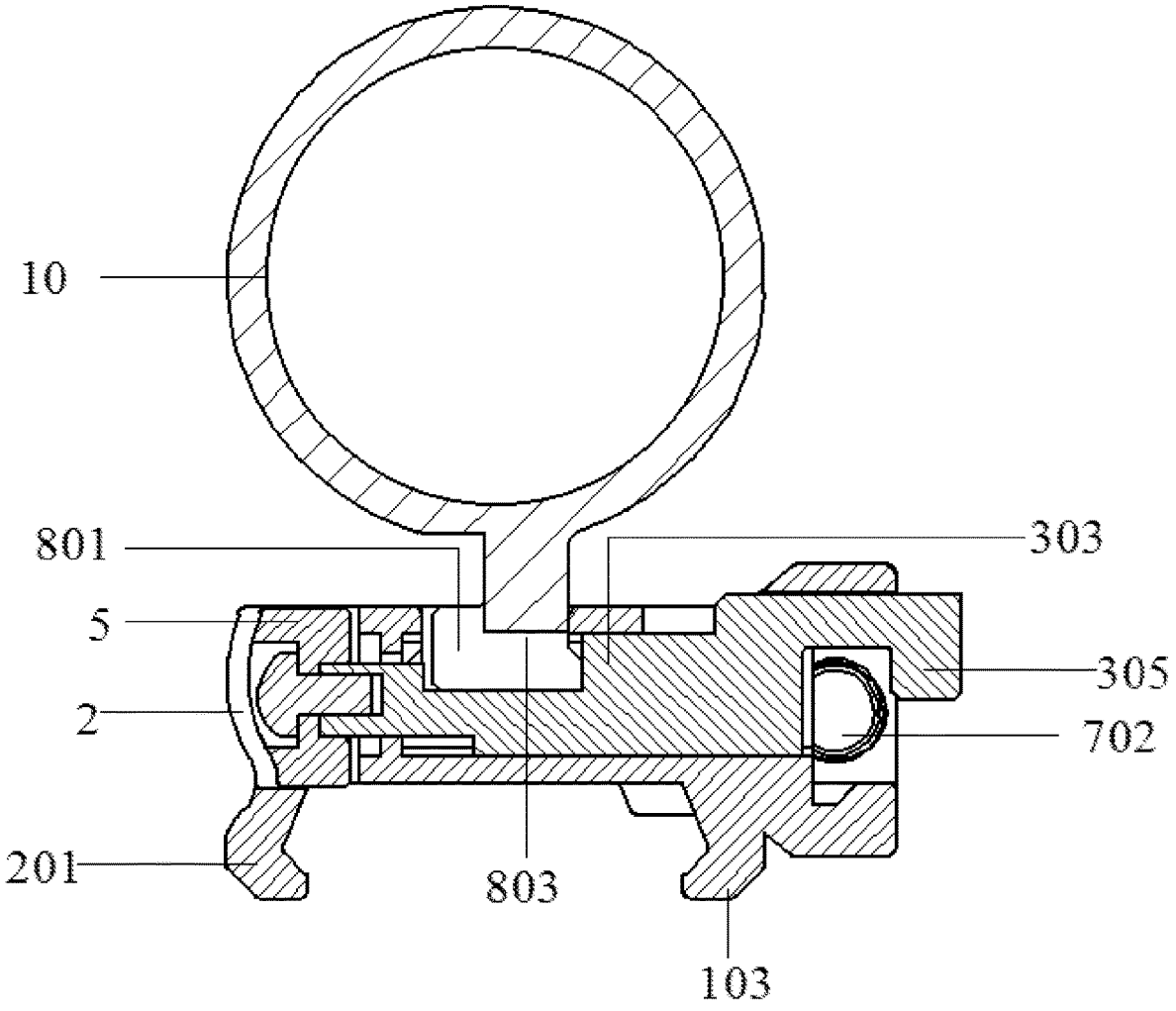
FIG. 7 is a schematic sectional view illustrating the first locking piece in an opened condition for mounting the light.
Figure 8:
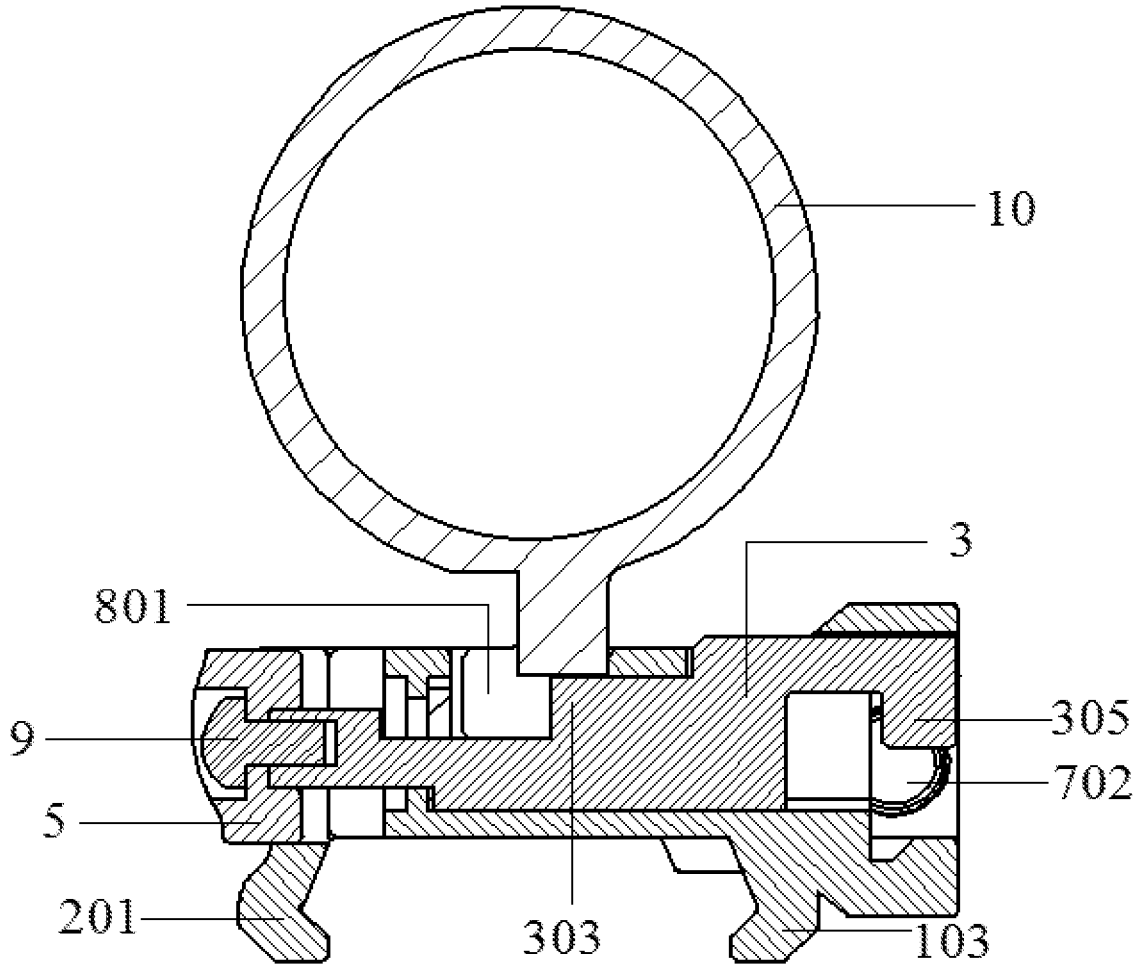
FIG. 8 is a schematic sectional view illustrating the light fixed by the first locking piece.

As shown in FIG. 7 and FIG. 8, when the slider 8 is mounted into the first sliding groove 101, press and hold the switch 5 to overcome the resilient force of the resilient piece 6, such that the main shaft 3 is driven away from the clamping block 2, as such, the first blocking piece 303 slides into an interior portion of the base between the first sliding groove 101 and the second sliding groove 102, while the first recess 302 is in communication with the first sliding groove 101, and as such, the slider 8 can be driven deep into the first sliding groove 101 until the slider 8 impacts against the first ball-headed rod 701; release the switch 5 and the main shaft 3 will reset under the resilient force of the resilient piece 6, and as such, the first blocking piece 303 slides into the position limiting groove 803 of the slider 8 to achieve position limiting of the slider 8 such that the slider 8 is fixed inside the first sliding groove 101.

Figure 9:
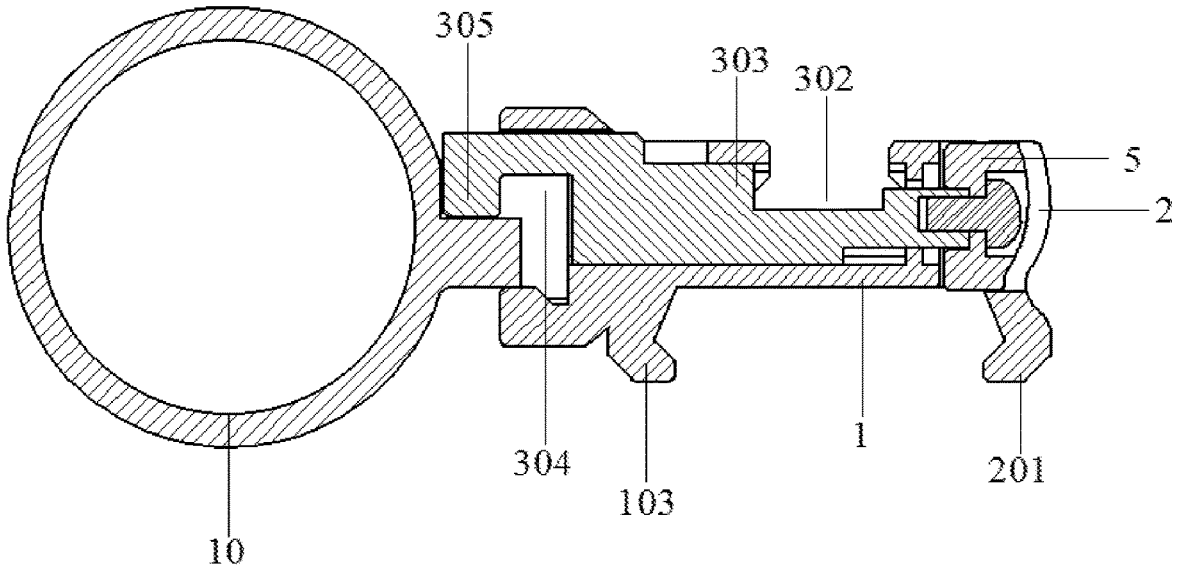
FIG. 9 is a schematic sectional view illustrating the second locking piece in an opened condition for mounting the light.
Figure 10:
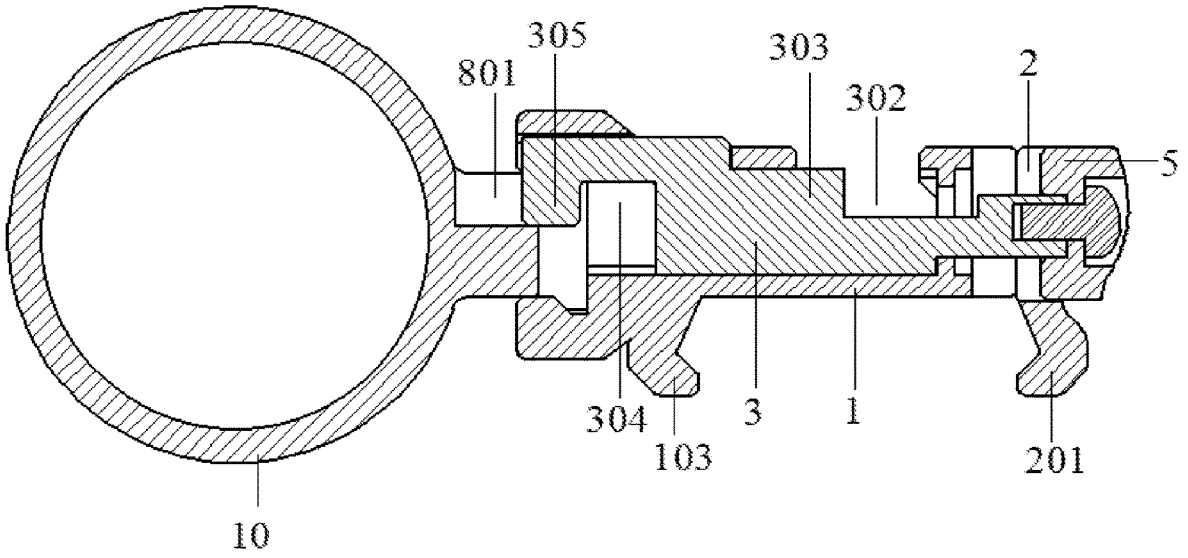
FIG. 10 is a schematic sectional view illustrating the light fixed by the second locking piece.

As shown in FIG. 9 and FIG. 10, when the slider 8 is mounted into the second sliding groove 102, press and hold the switch 5 to overcome the resilient force of the resilient piece 6, such that the main shaft 3 is driven away from the clamping block 2, as such, the second blocking piece 305 is also driven away from the base 1, while the second recess 304 is in communication with the second sliding groove 102, and as such, the slider 8 can be driven deep into the second sliding groove 102 until the slider 8 impacts against the second ball-headed rod 702; release the switch 5 and the main shaft 3 will reset under the resilient force of the resilient piece 6, and as such, the second blocking piece 305 slides into the position limiting groove 803 of the slider 8 to achieve position limiting of the slider 8 such that the slider 8 is fixed inside the second sliding groove 102.

Further, as described above, when the switch 5 is pressed and held, the first sliding groove 101 is in communication with the first recess 302 and the second sliding groove 102 is also in communication with the second recess 304, therefore each of the first sliding groove 101 and the second sliding groove 102 can be simultaneously provided with the slider 8 respectively. When the switch 5 is released and the main shaft 3 is reset, the two sliders are simultaneously fixed in position.

A gun mounted light is also provided by the present invention, comprising a light 10; one side of the light 10 is provided with the gun clamp easy to be dismounted and adjusted in position according to the above description. In an embodiment, the slider 8 is fixedly connected with the light 10. During use, the base 1 of the gun clamp is first fixed to one side of a rail of a gun, and then the light 10 is mounted to the first sliding groove 101 or the second sliding groove 102 of the base 1 via the slider 8; by fixing the slider 8 as described above, the light 10 is fixed, in other words, the light 10 is fixedly mounted to the rail.

According to the present invention, one and the same gun clamp can be mounted with two lights, or the light 10 can be adjusted between two different positions on the gun clamp according to practical situation. Also, by using one and the same switch 5, the first sliding groove and the second sliding groove can be simultaneously controlled to be in communication with the first recess and the second recess respectively, and thus opening the first sliding groove and the second sliding groove such that the slider can slide over the main shaft. Therefore, the present invention can be conveniently used by the users.

The above description is intended to illustrate only the more preferred embodiments of the present invention. General changes or replacements made by a person skilled in this field of art in accordance with the scope of teachings of the present invention should also fall within the scope of protection of the present invention.

What is claimed is:

1. A gun clamp, comprising a base and a slider; one side of the base is provided with a clamping assembly; another side of the base opposite to the side of the base provided with the clamping assembly is provided with a first sliding groove; a side wall of the base is provided with a second sliding groove; the slider is cooperative with and insertable into the first sliding groove or the second sliding groove; a main shaft is provided in the base connecting the first sliding groove and the second sliding groove; an end of the main shaft proximal to the first sliding groove is provided with a first locking piece; an end of the main shaft proximal to the second sliding groove is provided with a second locking piece; an end of the main shaft distal from the second locking piece is connected with a switch; the switch is positionally limited at another side wall of the base distal from the second sliding groove.

2. The gun clamp of claim 1, wherein a resilient piece is provided between the switch and the base.

3. The gun clamp of claim 1, wherein the first locking piece comprises a first blocking piece and a first recess; the first recess is positioned adjacent to an end of the first blocking piece proximal to the switch.

4. The gun clamp of claim 1, wherein the second locking piece comprises a second blocking piece and a second recess; the second blocking piece is positioned adjacent to an end of the second recess distal from the switch.

5. The gun clamp of claim 1, wherein one side of the slider comprises a third blocking piece, a fourth blocking piece and a position limiting groove; the position limiting groove is positioned between the third blocking piece and the fourth blocking piece.

6. The gun clamp of claim 1, wherein a position limiting panel is provided at a side of the base corresponding to openings of the first sliding groove and the second sliding groove opposite to opposite openings of the first sliding groove and the second sliding groove from which the slider is inserted.

7. The gun clamp of claim 6, wherein a side of the position limiting panel proximal to the base is provided with a first ball-headed rod; the first ball-headed rod is positioned corresponding to the first sliding groove.

8. The gun clamp of claim 6, wherein a side of the position limiting panel proximal to the base is provided with a second ball-headed rod; the second ball-headed rod is positioned corresponding to the second sliding groove.

9. The gun clamp of claim 7, wherein a side of the position limiting panel proximal to the base is provided with a second ball-headed rod; the second ball-headed rod is positioned corresponding to the second sliding groove.

10. A gun mounted light, comprising a light, wherein one side of the light is provided with the gun clamp according to claim 1.

11. A gun mounted light, comprising a light, wherein one side of the light is provided with the gun clamp according to claim 3.

12. A gun mounted light, comprising a light, wherein one side of the light is provided with the gun clamp according to claim 3.

13. A gun mounted light, comprising a light, wherein one side of the light is provided with the gun clamp according to claim 4.

14. A gun mounted light, comprising a light, wherein one side of the light is provided with the gun clamp according to claim 5.

15. A gun mounted light, comprising a light, wherein one side of the light is provided with the gun clamp according to claim 6.

16. A gun mounted light, comprising a light, wherein one side of the light is provided with the gun clamp according to claim 7.

17. A gun mounted light, comprising a light, wherein one side of the light is provided with the gun clamp according to claim 8.

18. A gun mounted light, comprising a light, wherein one side of the light is provided with the gun clamp according to claim 9.

* * * * *